US005992800A

United States Patent [19]

Sass

[11] Patent Number: 5,992,800

[45] Date of Patent: Nov. 30, 1999

[54] RAILROAD CROSSING ARM BREAKAWAY CONNECTOR

[75] Inventor: Ron C. Sass, Savannah, Ga.

[73] Assignee: National Electric Gate Company Inc., Pooler, Ga.

[21] Appl. No.: 09/003,306

[22] Filed: Jan. 6, 1998

[51] Int. Cl.[6] ..... E05D 15/00

[52] U.S. Cl. ..... 246/127; 49/381

[58] Field of Search ..... 246/125, 127, 246/261, 272; 49/141, 381, 192

[56] References Cited

U.S. PATENT DOCUMENTS

| | | | |
|---|---|---|---|
| 1,874,926 | 8/1932 | Dilley et al. . | |
| 3,952,978 | 4/1976 | Reinitz | 246/477 |
| 4,219,969 | 9/1980 | Reinitz et al. | 49/141 |
| 4,364,200 | 12/1982 | Cobb | 49/141 |

OTHER PUBLICATIONS

Catalog, National Electric Gate Company, (33 pages) no date.

*Primary Examiner*—Mark T. Le

*Attorney, Agent, or Firm*—Thomas, Kayden, Horstemeyer & Risley

[57] ABSTRACT

The pivot pin (26) connects the gate arm (14) and adapter (28) to the extension plate (24), and cross pin (32) supports the supporting pins (34) unless shear pins (50) are removed or destroyed. When the shear pins are removed and the gate arm moves horizontally (FIG. 2), its support pins move toward a parallel position with respect to the cross pin (32), which would normally allow the gate arm to drop to the ground in a disabled position. When maintenance is to be performed on the gate arm, the temporary retainer nut (10) is threaded onto the lower end (48) of the pivot pin to keep the gate arm from falling and the shear pins (50) are extracted so that the gate arm can be moved through a horizontal arc out of the road blocking horizontal position without falling to the ground.

7 Claims, 2 Drawing Sheets

RAILROAD CROSSING ARM BREAKAWAY CONNECTOR

FIELD OF THE INVENTION

The invention relates to automobile traffic control devices and more particularly to moveable gate arms for use at railroad crossings and other traffic control locations to control the traffic across railroad tracks, etc.

DESCRIPTION OF THE PRIOR ART

Controllable crossing gate arms have long been employed in various situations where a physical barrier is required to prevent traffic flow. These crossing gate arms are capable of pivoting upwardly out of the path of traffic in response to a command signal, thereby allowing the traffic to move freely when the barrier is not required. Typically, crossing gate arms are employed along roadways which cross railroad lines, as well as at highway toll booths and draw bridges in order to prevent passage of an automobile without payment of a desired toll or to allow a bridge to open.

Until the mid 1960's, crossing gate arms found at railway grade crossings were severely damaged or destroyed if struck by a highway vehicle when the crossing gate arm was in a road blocking horizontal attitude. Subsequently, a breakaway system was developed which protects crossing gates from collision damage. This breakaway system incorporates a pivot pin and shear pins which enable the gate arm to swing out of the way of traffic in response to a collision with an automobile and drop free of the crossing arm support structure to the ground in a disabled position displaced from and approximately parallel to the roadway.

The pivot pin of the prior art crossing arm assembly is connected between a crossing gate arm and its support structure. The support structure pivots the gate arm through a vertical arc between a road blocking horizontal attitude and an open road vertical attitude. The pivot pin and gate arm cooperate so that the gate arm is free to pivot through a defined horizontal arc about the pivot pin from the road blocking horizontal attitude to a release position parallel to the roadway when an automobile strikes the gate arm. During normal operation, this horizontal pivoting motion is inhibited by the use of shear pins which are mounted through the crossing arm support structure and the gate arm adapter, such that the gate arm remains in a fixed position relative to the support structure while the shear pins are in place. These pins retain the position of the gate arm until they are manually removed during maintenance of the gate arm, or until they are sheared from the support structure by the force of an automobile striking the gate arm.

Once an automobile strikes the gate arm and the gate arm swings to the release position, the gate arm adapter is arranged so that the adapter and connected gate arm freely fall away from the pivot pin and drop to the ground in the disabled position. This breakaway function allows the gate arm to fall away from the roadway as well as the railroad tracks, thus ensuring that the gate arm will not be a further hazard to traffic, and will not be further damaged once it has detached from the support structure. The gate arm typically is damaged by the automobile impact that prompted the breakaway function so that repair usually is required of the gate arm.

The prior art breakaway system, however, does not provide a means for safe and effective maintenance of the gate arm. In particular, when the prior art gate arm requires maintenance, a maintenance person is usually required to lower the gate arm to the road blocking horizontal attitude, and to either: (1) perform required maintenance on the gate arm while being personally positioned in the roadway, or (2) remove any shear pins which connect the gate arm to the supporting structure so that the gate arm is free to rotate in a horizontal arc to the release position, where the gate arm automatically disconnects from its supporting structure and falls to the ground, thus allowing the gate to be removed from the roadway for maintenance. It should be readily apparent that option (1) presents a clear physical hazard to maintenance personnel since their position in the roadway places them in close proximity to traffic and often times careless and inattentive drivers. Option (2), although reducing potential physical harm to maintenance personnel, presents an opportunity for the gate arm to incur additional damage. This is because gate arms typically are long, are unevenly balanced and are usually overall difficult for a single maintenance person to manage. When a maintenance person attempts to reattach the gate arm to its support structure following maintenance, gate arms are subject to being damaged by inadvertent contact with other structures and the ground. This cumbersome reattachment process is likely to cause stress and fatigue to the maintenance person, therefore, the maintenance person is more likely to choose the more hazardous option (1) to more conveniently perform maintenance on the gate arm.

In the railroad crossing arm assembly of the present invention, the above-described problem found in prior art structures is eliminated while providing a crossing gate arm breakaway connector capable of quick and easy temporary disablement of the gate arm in a position parallel to the roadway for maintenance and repair, and then expedient return of the gate arm to a fully operative position by a single unskilled person.

By employing the retainer of this invention, a safer and more convenient means of conducting maintenance and repair on the gate arm is provided.

SUMMARY OF THE INVENTION

Briefly described, the present invention comprises a breakaway connector for a crossing arm assembly which has a crossing arm connected by a pivot pin to a support structure with the crossing arm being pivotable about the pivot pin when moved through a horizontal arc to a release position parallel to the roadway. The connector includes a removable retainer which mounts to the lower end portion of the pivot pin of the gate arm such that when attached, the retainer securely holds the gate assembly to the pivot pin and the associated support structure in a position where the prior art gate arm would otherwise disconnect from the support structure. Preferably, the retainer incorporates an internally threaded nut which engages an externally threaded lower end portion of the pivot pin of the gate arm support structure. The nut is threaded upwardly onto the threaded lower end portion of the pivot pin until the nut engages and supports the gate arm from the pivot pin. With this arrangement, when the gate arm pivots about the pivot pin to its release position in which the gate arm normally would be allowed to fall to the ground, the nut at the lower end of the pivot pin continues to support the gate arm on the pivot pin and the gate arm is not allowed to fall to the ground.

Shear pins normally keep the gate arm from moving through the horizontal arc to the release position. When the gate arm is to be pivoted to the release position, the shear pins are removed and the gate arm is free to pivot. The crossing gate arm breakaway connector is capable of quick and easy temporary disablement of the gate arm in the release position, a position parallel to the roadway, for maintenance and repair, and then expedient return of the gate arm to a fully operative position by a single unskilled person.

Therefore, an object of the present invention is to provide an improved means of temporarily disabling the prior art breakaway coupling system of a railroad crossing gate assembly for ease of maintenance and safety of maintenance personnel.

Another object of the present invention is to provide an improvement to the prior art railroad crossing gate assembly which is inexpensive and easily incorporated without extensive on-site modification of existing equipment.

Another object of the invention is to eliminate the prior art difficulty of gate maintenance and repair by providing a removable retainer which mounts to the support structure of the gate arm such that the retainer securely holds the gate arm to the support structure in a position where the prior art gate arm would normally disconnect from the support structure

BRIEF DESCRIPTION OF THE DRAWINGS

The accompanying drawings incorporated in and forming a part of the specification illustrate several aspects of the present invention, and together with the description serve to explain the principles of the invention. The components in the drawings are not necessarily to scale, emphasis instead being placed upon clearly illustrating principles of the present invention. In the drawings appended hereto, like numerals illustrate like parts throughout the several views.

DETAILED DESCRIPTION OF THE INVENTION

Figure 1:
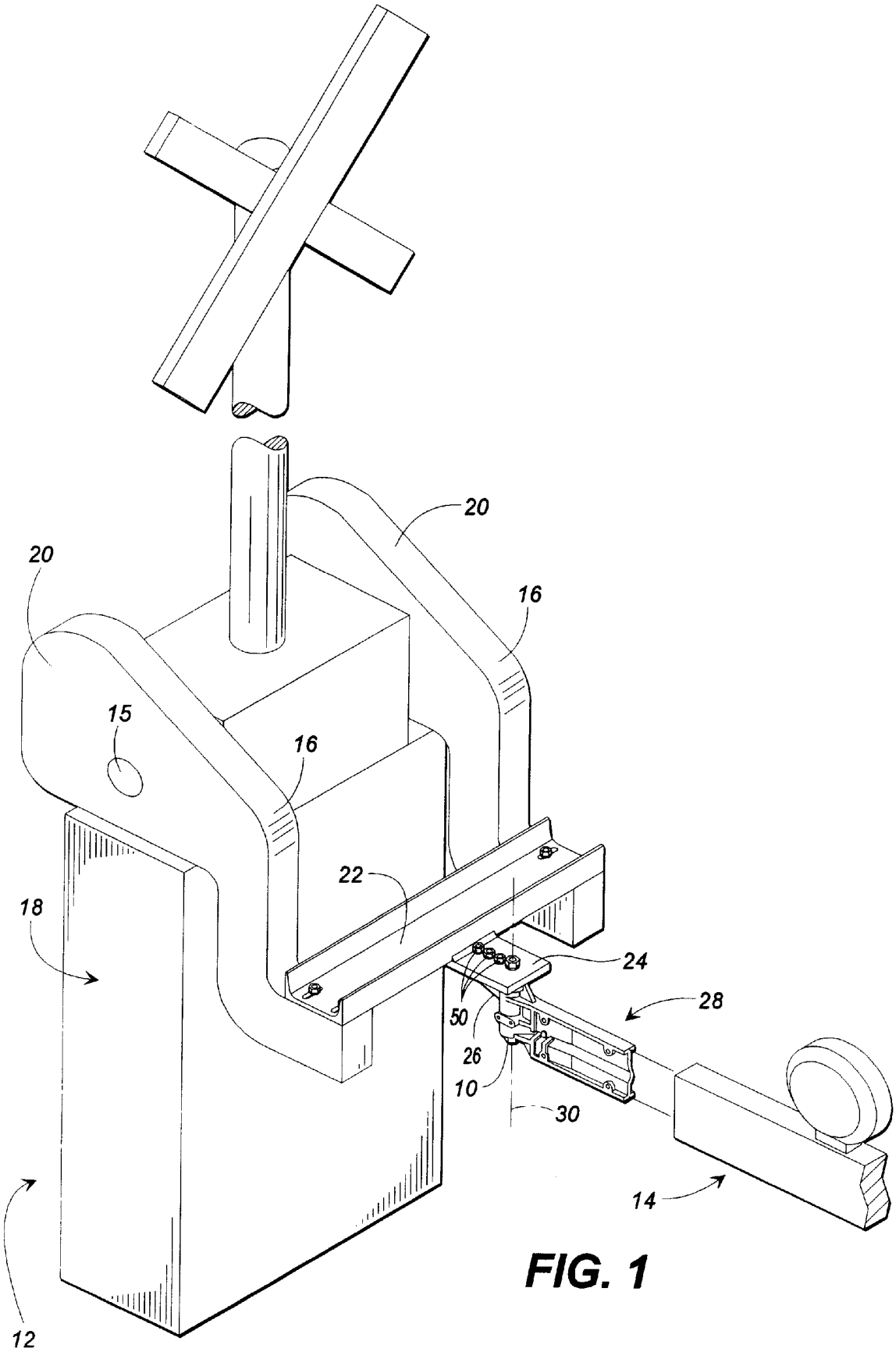
FIG. 1 is a perspective view of a railroad crossing gate assembly incorporating the retainer of the present invention.
Figure 3:
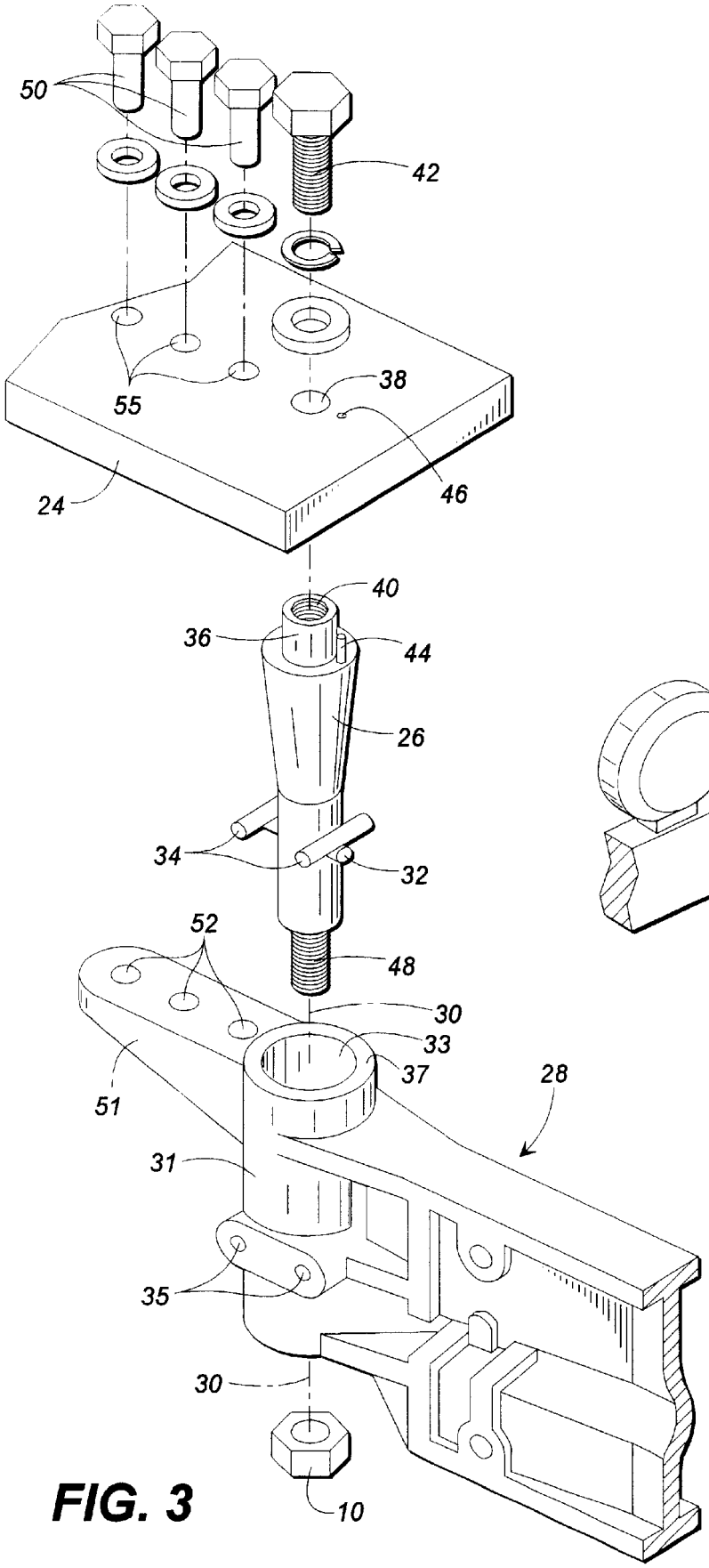
FIG. 3 is a partially broken away exploded perspective view of the breakaway assembly and retainer.
Figure 2:
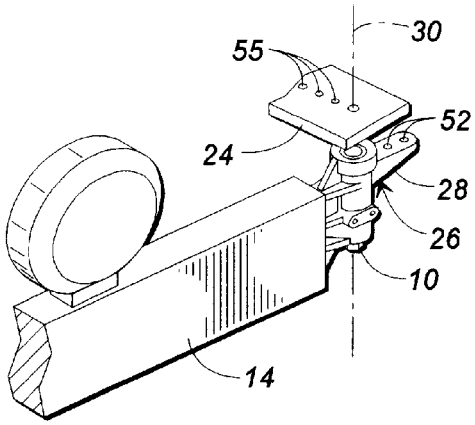
FIG. 2 is a partially broken away perspective view showing the gate arm and adapter pivoted to the release position with the retainer installed.

By simultaneously referring to FIGS. 1, 2 and 3, the construction and operation of a railroad crossing assembly can best be understood. In general, the railroad crossing arm breakaway connector of the present invention incorporates a removable retainer which may be securely mounted to a pivot pin of a gate arm support structure during maintenance functions so that the breakaway function can be avoided.

In FIG. 1 retainer 10 of the present invention is shown mounted to a typical railroad crossing gate assembly 12. As discussed above, retainer 10 can be employed in various other traffic control devices, such as toll booth arm assemblies, without in any way departing from the scope of the present invention. However, for exemplary purposes only, retainer 10 is shown and described throughout the remainder of this specification in reference to its applicability and installation on a railroad crossing arm assembly.

As is well known in the art, railroad crossing gate assembly 12 incorporates a gate arm 14 and support arms 16. Support arms 16 pivot about shaft 15 and about control assembly 18 wherein a control mechanism is contained. Also, counterweights 20 are mounted at the end of each support arm 16 to balance the weight of gate arm 14.

Support arms 16 are joined by horizontal coupling plate 22. Coupling plate 22 incorporates extension plate 24 which is attached to pivot pin assembly 26. Pivot pin assembly 26 also pivotally engages adapter 28. When the control mechanism receives a first command signal, the control mechanism pivots gate arm 14 about pivot shaft 15 upwardly through a vertical arc, raising it from a road blocking horizontal attitude, shown in FIG. 1, to an open road vertical attitude such that the gate arm is substantially vertical to the ground. The use of counterweight means 20 at the end of support arms 16 assist in counterbalancing the weight of gate arm 14 thereby reducing the rotational force needed for the pivoting action. When a second command signal is received by the control mechanism, gate arm 14 is pivoted downwardly through the vertical arc, lowering it from the open road vertical attitude to the road blocking horizontal attitude shown in FIG. 1, effectively blocking the roadway.

Pivot pin 26 has a longitudinal pivot axis 30 and is mounted to extension plate 24 and incorporates a support means for adapter 28. As shown in FIG. 3, the preferred embodiment of the support means is cross pin 32. Cross pin 32 extends through and is supported by stationary pivot pin 26, with its ends protruding at opposite sides from the pivot pin. Support pins 34 mounted on adapter 28 extending as chords through the vertical cylindrical opening 33, telescopically inserted through side openings 35, and supported at their ends in the sidewall 37 of the adapter sleeve 31. The support pins rest on the ends of the cross pin 32. Thus, the adapter and gate arm are retained by pivot pin 26 while in all positions, except a release position, shown in FIG. 2. When the gate arm has pivoted toward the release position, pins 34 rotate toward a position parallel to the cross pin and lose supporting engagement with the cross pin. Therefore, the pins 32 and 34 function as releasable support means for disengaging the adapter 28 and gate arm 14 from the pivot pin 26 and allow the adapter and the gate arm to fall away from the pivot pin to a disabled position on the ground.

Pivot pin 26 is mounted to extension plate 24 by incorporating a first or upper end portion 36 mounted through hole 38 of the extension plate. First end portion 36 contains a threaded bore 40 which threadedly engages bolt 42 to securely mount pivot pin 26 to extension plate 24. Pivot pin 26 additionally incorporates locating pin 44 which extends into locator hole 46 in extension plate 24 so that pivot pin 26 and support means 32 are properly oriented.

Furthermore, in the preferred embodiment pivot pin 26 incorporates a second or lower end portion 48 which is externally threaded. Second end portion 48 extends through adapter 28 and threadedly engages retainer 10 so that the adapter is securely held onto pivot pin 26 when the retainer is mounted thereon.

Shear pin arm 51 extends laterally from sidewall 37 of adapter sleeve 31, and shear pins 53 normally are extended through aligned openings 52 and 55 of extension plate 24 and shear pin arm 51.

Breakaway Operation

During normal use, adapter 28 of the present invention cooperates with shear pins 50 in order to maintain gate arm 12 in a fixed position relative to support arms 16 for continuous operation. Shear pins 50 shown in FIGS. 1 and 3 therefore function as shear means to releasably hold the gate arm in alignment with extension plate 24. Gate arm 14 can be pivotally raised upwardly through the vertical arc from the road blocking horizontal attitude to the open road vertical attitude by the control system in order to allow cars to freely pass across the railroad tracks. However, when the control system receives a signal that a train is approaching, gate arm 14 is lowered downwardly through the vertical arc to the road blocking horizontal attitude, as shown in FIG. 1, to provide a physical blockade which will deter drivers of automobiles from crossing the tracks whenever the danger of an approaching train exists.

As discussed above, gate arm 14 is occasionally struck by a moving automobile. When this occurs, shear pins 50 shear from adapter 28 so that the adapter and the gate arm are free to pivot through the defined horizontal arc from the road blocking horizontal attitude to the release position. When the adapter reaches the release position, cross pin 32 selectively disengages support pins 34 such that the adapter and gate arm are no longer supported by the pivot pin. Once disengaged, the adapter and gate arm will completely disconnect from the supporting structure and freely fall to the ground in a disabled position. During proper operation, the gate arm will come to rest parallel to the roadway and away from the railroad tracks, such that the gate arm no longer presents a hazard to automobile or railroad traffic.

The horizontal pivoting operation of gate arm 14 can best be seen and understood by referring to FIG. 2. As shown in FIG. 2, adapter 28 and gate arm 14 have pivoted through the horizontal arc from the road blocking horizontal attitude to the release position where the prior art gate assembly disengages from the pivot pin. However, FIG. 2 illustrates incorporation of the improvement, retainer 10, which securely holds the gate arm assembly to the pivot pin while the gate arm is in the release position. This enables the gate arm 14 to remain attached to the extension plate 24 while maintenance is performed on the gate arm and related equipment. When the gate arm is ready to be returned for normal service, it is pivoted back through its horizontal arc until the shear pin openings 52 and 55 become aligned. The shear pins 50 are then reinserted into the shear pin openings and the removable retainer nut 10 is removed from the lower end of the pivot pin.

The foregoing description has been presented for purposes of illustration and description. It is not intended to be exhaustive or to limit the invention to the precise forms disclosed. Obvious modifications or variations are possible in light of the above teachings. The embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

I claim:

1. In a railroad crossing arm assembly comprising:

a support mechanism for mounting adjacent the intersection of a roadway and a railroad track;

a pivot arm support assembly pivotally connected to said support mechanism;

a pivot pin mounted to said pivot arm support assembly;

an adapter mounted to said pivot pin;

a gate arm mounted to said adapter;

said support mechanism including means for tilting said pivot arm support assembly, said adapter and said gate arm between a first position in which said gate arm is oriented in an open road vertical attitude and a second position in which the gate arm is oriented in a road blocking horizontal attitude;

said pivot pin pivotally connecting said adapter and said gate arm to said pivot arm support assembly about an upright axis when said gate arm is oriented in its road blocking horizontal attitude such that said adapter and said gate arm can pivot through a horizontal arc between the road blocking horizontal attitude and a release position defined at a predetermined angle relative to said road blocking horizontal attitude;

said pivot pin and said adapter including releasable support means for disengaging said adapter and said gate arm from said pivot pin in response to said adapter and said gate arm pivoting through said horizontal arc to said release position such that the gate will fall freely to the ground to a disabled position where the gate will not block the roadway when the gate arm has been disengaged;

wherein the improvement comprises:

a retainer releasably mounted to said pivot pin such that in a mounted position said retainer retains said adapter to said pivot arm support assembly when said adapter and said gate arm have pivoted to the release position.

2. A railroad crossing arm assembly according to claim 1, further comprising a shearable locking mechanism removeably attached to said pivot arm support assembly and in operable cooperation with said adapter such that the adapter is locked in position relative to said pivot arm support assembly.

3. In a railroad crossing arm assembly comprising:

a support mechanism for mounting adjacent the intersection of a roadway and a railroad track, a pivot arm support assembly pivotally connected to said support mechanism;

a pivot pin mounted to said pivot arm support assembly;

an adapter mounted to said pivot pin;

a gate arm mounted to said adapter;

said support mechanism including means for tilting said pivot arm support assembly, said adapter and said gate arm between a first position in which said gate arm is oriented in an open road vertical attitude and a second position in which the gate arm is oriented in a road blocking horizontal attitude;

said pivot pin pivotally connecting said adapter and said gate arm to said pivot arm support assembly about an upright axis when said gate arm is oriented in its road blocking horizontal attitude such that said adapter and said gate arm can pivot through a horizontal arc between the road blocking horizontal attitude and a release position, said release position defined at a right angle relative to said road blocking horizontal attitude;

said pivot pin and said adapter including releasable support means for disengaging said adapter and said gate arm from said pivot pin in response to said adapter and said gate arm pivoting through said horizontal arc to said release position such that the gate will fall freely to the ground to a disabled position where the gate will not block the roadway when the gate arm has been disengaged;

wherein the improvement comprises:

a retainer releasably mounted to said pivot pin in a position to retain said adapter to said pivot arm support assembly when said adapter and said gate arm have pivoted to the release position.

4. In a railroad crossing arm assembly comprising:

a support mechanism for mounting adjacent the intersection of a roadway and a railroad track;

a pivot arm support assembly pivotally connected to said support mechanism;

a pivot pin mounted to said pivot arm support assembly;

an adapter mounted to said pivot pin;

a gate arm mounted to said adapter;

said support mechanism including means for tilting said pivot arm support assembly, said adapter and said gate arm between a first position in which said gate arm is oriented in an open road vertical attitude and a second position in which the gate arm is oriented in a road blocking horizontal attitude;

said pivot pin pivotally connecting said adapter and said gate arm to said pivot arm support assembly about an upright axis when said gate arm is oriented in its road blocking horizontal attitude such that said adapter and said gate arm can pivot through a horizontal arc between the road blocking horizontal attitude and a release position defined at a predetermined angle relative to said road blocking horizontal attitude;

said pivot pin and said adapter including releasable support means for disengaging said adapter and said gate arm from said pivot pin in response to said adapter and said gate arm pivoting through said horizontal arc to said release position such that the gate will fall freely to the ground to a disabled position where the gate will not block the roadway when the gate arm has been disengaged;

wherein the improvement comprises:

said pivot pin having an end portion for protruding below said adapter, said end portion being threaded; and, a threaded nut for threadedly engaging the end portion of said pivot pin and supporting said adapter on said pivot pin when said adapter and said gate arm have pivoted to the release position.

5. A pivot pin assembly in a railroad crossing arm assembly, the railroad crossing arm assembly having a support mechanism for mounting adjacent the intersection of a roadway and a railroad track, a pivot arm support assembly pivotally connected to the support mechanism, an adapter pivotally mounted to the support mechanism, a gate arm mounted to the adapter, the support mechanism including means for tilting the pivot arm support assembly, the adapter and the gate arm between a first position in which the gate arm is oriented in an open road vertical attitude and a second position in which the gate arm is oriented in a road blocking horizontal attitude, said pivot pin assembly comprising:

a pivot pin configured to pivotally connect the adapter and the gate arm to the pivot arm support assembly about an upright axis when the gate arm is oriented in its road blocking horizontal attitude such that the adapter and the gate arm are pivotable about the pivot pin through a horizontal arc between the road blocking horizontal attitude and a release position defined at a predetermined angle relative to the road blocking horizontal attitude;

said pivot pin being arranged to be disengagable from the adapter in response to the adapter and the gate arm pivoting through the horizontal arc to the release position such that the gate arm is configured to fall freely to the ground to a disabled position where the gate arm will not block the roadway when the adapter disengages said pivot pin, and a retainer releasably mounted to said pivot pin such that in a mounted position said retainer retains the adapter to said pivot pin when the adapter and the gate arm have pivoted to the release position.

6. The invention of claim 5, wherein said pivot pin has an end portion configured to protrude below the adapter, said end portion being threaded, and said retainer is a threaded nut configured to threadedly engage said end portion of said pivot pin such that said threaded nut supports the adapter on said pivot pin when the adapter and the gate arm have pivoted to the release position.

7. The invention of claim 5, wherein the release position is defined at an angle of at least approximately 90 degrees relative to the road blocking horizontal attitude.

* * * * *